United States Patent [19]

Kilpatrick

[11] 3,986,551

[45] Oct. 19, 1976

[54] HEAT EXCHANGER

[75] Inventor: Lester Louis Kilpatrick, Grifton, N.C.

[73] Assignee: E. I. Du Pont de Nemours and Company, Wilmington, Del.

[22] Filed: May 20, 1975

[21] Appl. No.: 579,363

[52] U.S. Cl. ..... 165/141; 23/283; 165/154

[51] Int. Cl.[2] ..... F28D 7/10

[58] Field of Search ..... 165/141.2, 154–156, 165/170, 171, 181, 6, 5, 177–179, 133; 261/112; 122/367 R; 159/28 P

[56] References Cited

UNITED STATES PATENTS

| | | | |
|---|---|---|---|
| 1,132,420 | 3/1915 | Anderav | 165/141 |
| 1,989,773 | 2/1935 | Snow | 261/112 |
| 1,989,774 | 2/1935 | Snow | 261/112 |
| 2,706,620 | 4/1955 | Graves | 165/156 X |
| 3,776,018 | 12/1973 | French | 165/177 |

*Primary Examiner*—Charles J. Myhre
*Assistant Examiner*—Theophil W. Streule, Jr.

[57] ABSTRACT

A heat exchanger including concentric cylindrical elements having fins formed on adjacent surfaces of the cylinders which form a flow passage for polymer. The fins are separated by a series of spaced left-hand and spaced right-hand helical grooves circumferentially around the adjacent surfaces of the cylinders. The left-hand grooves differ in width from the right-hand grooves to promote mixing and improve heat transfer efficiency.

9 Claims, 4 Drawing Figures

FIG. 1
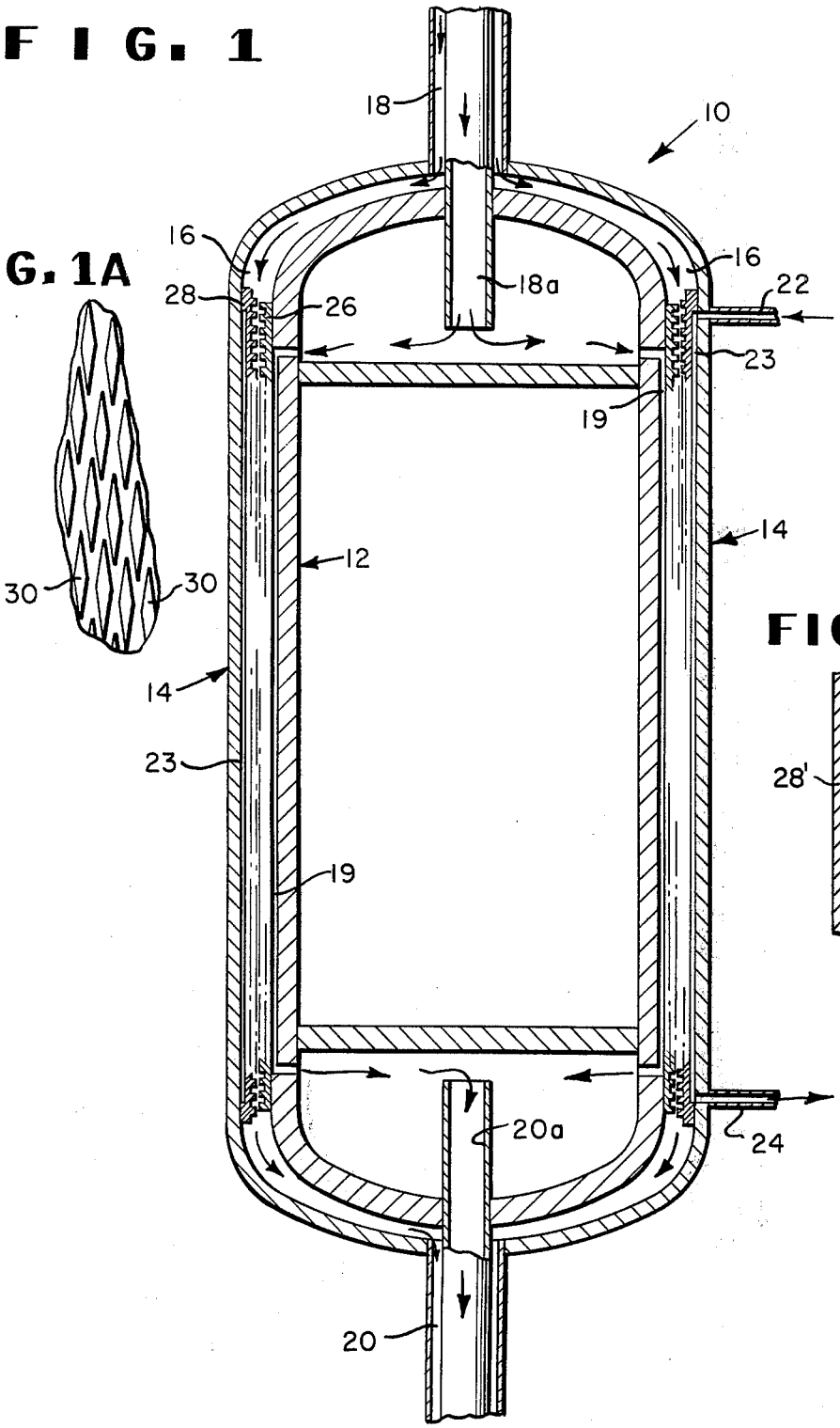
FIG. 1A
FIG. 1B
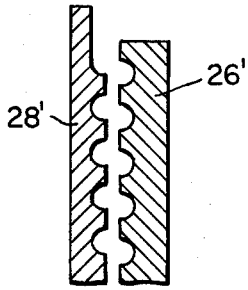

HEAT EXCHANGER

BACKGROUND OF THE INVENTION

This invention relates to heat exchangers and more particularly to heat transfer surfaces within a polymer cooler.

Historically polymer has been cooled by Dowtherm jacketed screw pumps used to forward the polymer, however, as throughputs increase, this method becomes less effective because the cooling effect is partially or totally offset by heat generated in the polymer from screw rotation.

SUMMARY OF THE INVENTION

A static heat exchanger has been developed which is especially useful for cooling polymers with laminar flow characteristics and eliminates the disadvantages of the rotating screw pump while maintaining the mixing action desired for processing these polymers to approach uniform thermal history throughout the polymer.

The heat exchanger of this invention includes an inner cylinder concentrically positioned within an outer cylinder of greater diameter so that adjacent wall surfaces of the cylinders form an annular passage for the flow of polymer from an inlet to an outlet of the exchanger. Provisions were made for coolant to flow past the inner wall surface of the inner cylinder and past the outer wall surface of the outer cylinder. The adjacent wall surfaces of the annular passage have fins formed on the surface between spaced left-hand and spaced right-hand helical grooves in the adjacent wall surfaces of the cylinders. An important feature of the invention is that the left-hand grooves differ in width from the right-hand grooves. This structural arrangement of the fins and the grooves of different widths promotes polymer mixing in the annular passage and improves efficiency of heat transfer.

BRIEF DESCRIPTION OF THE DRAWINGS

FIG. 1 is a sectioned elevation of the polymer heat exchanger of this invention.

FIG. 1A is an enlargement of adjacent wall surfaces shown in FIG. 1.

FIG. 1B shows an alternate embodiment for the grooves in FIG. 1 slightly enlarged.

DETAILED DESCRIPTION OF THE PREFERRED EMBODIMENT

Figure 2:
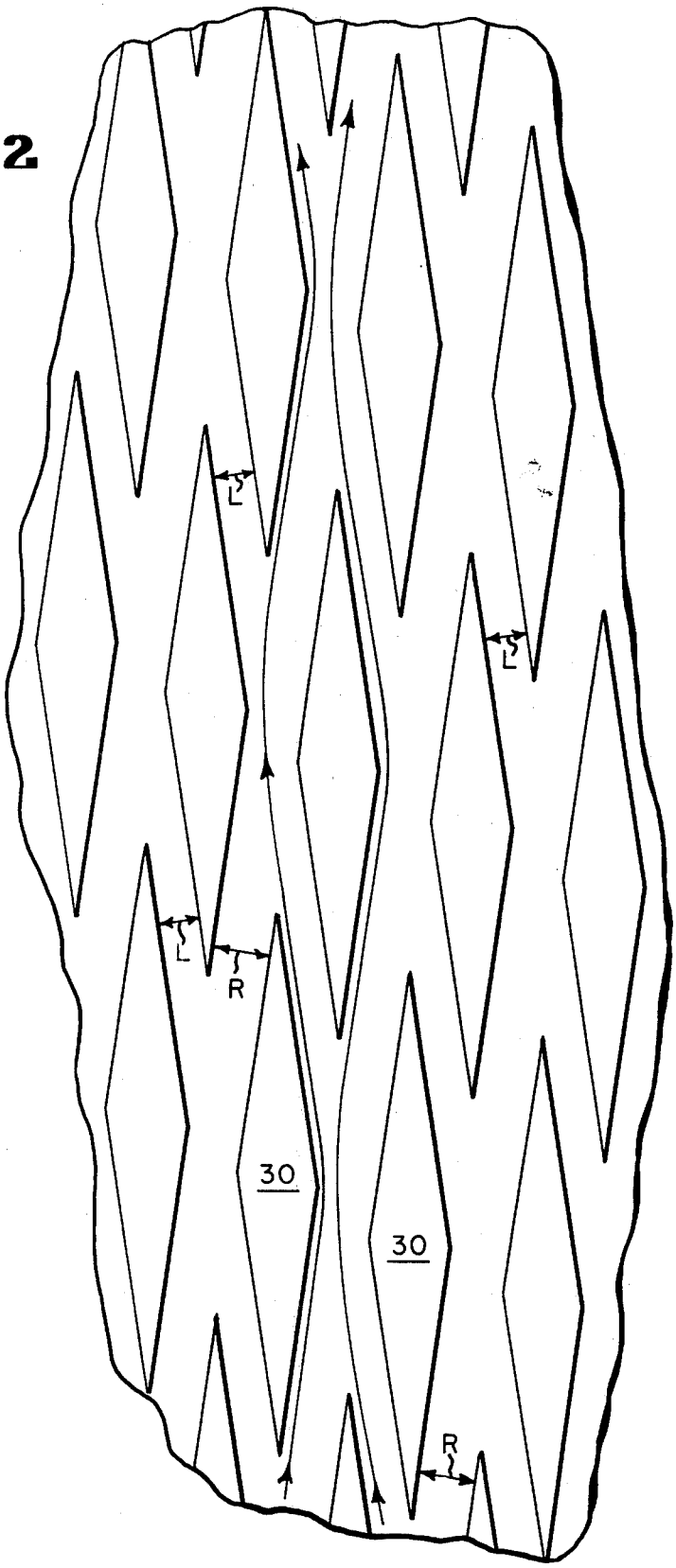
FIG. 2 is an enlarged view of the shaped patterning formed on adjacent wall surfaces of the annular polymer passage in FIG. 1.

Referring now to FIG. 1, the heat exchanger or polymer cooler is generally designated as 10 and includes an inner cylinder 12 concentrically positioned within an outer cylinder 14 of greater diameter to form an annular passage generally designated 16 for the flow of polymer from the heat exchanger inlet 18 to its outlet 20. Dowtherm is used as a coolant and is circulated to the inside of cylinder 12 through inlet 18*a*, passage 19 in the side wall of cylinder 12, and out through coolant outlet 20*a*. In a similar fashion, the coolant is also circulated to the outer cylinder 14, i.e., through inlet 22, passage 23 in the side wall of cylinder 14 and out through coolant outlet 24.

In the preferred embodiment, the adjacent wall surfaces 26, 28 of the respective inner and outer cylinders 12, 14, are provided with integrally formed parallelogram shaped fins 30 aligned axially with the cylinders. An enlargement of the adjacent wall surfaces is shown in FIG. 1A. Adjacent fins are separated by a series of diagonally cut grooves defining parallel equispaced left-hand helical grooves L and equispaced right-hand helical grooves R which extend circumferentially around the adjacent surfaces of cylinders 12 and 14. An important feature of this arrangement is that grooves R are wider than grooves L. In FIG. 2, the fins 30 are rhomboid shaped, i.e., a parallelogram with unequal adjacent sides; this shape along with the unequal groove or channel width of grooves L and R promote mixing, as indicated by the flow arrows, which in turn improves the efficiency of heat transfer between the coolant and the polymer.

The cylinders 12, 14 may be assembled so that the fins in adjacent wall surfaces are directly opposed or the fins may be circumferentially displaced from one another on adjacent walls.

While in the preferred embodiment the fins are shown as a true rhomboid separated by rectangular grooves, the sharp corners of the fins may be rounded off and the grooves may be arcuate as shown in adjacent wall surfaces 26', 28' in FIG. 1B. Rather than rectangular without a noticeable effect on the efficiency of the heat exchanger.

What is claimed is:

1. In a heat exchanger that includes an inner cylinder concentrically positioned within an outer cylinder of greater diameter, adjacent wall surfaces of said cylinders forming a passage for the flow of material from an inlet to an outlet and means to provide coolant to the inner wall surface of the inner cylinder and to the outer wall surface of the outer cylinder, the improvement comprising, said adjacent wall surfaces having fins formed thereon, said fins being formed between spaced left-hand and spaced right-hand helical grooves in said wall surfaces, said left-hand grooves being of different width from said right-hand helical grooves.

2. The heat exchanger of claim 1, said fins being formed between equispaced left-hand and equispaced right-hand helical grooves.

3. The heat exchanger of claim 1, said fins on adjacent surfaces being directly opposed.

4. The apparatus as defined in claim 1, said fins on adjacent surfaces being displaced circumferentially from an opposed position from each other by the distance of one-half the width of a fin.

5. The heat exchanger of claim 1, said right-hand helical grooves being wider than said left-hand grooves.

6. The heat exchanger of claim 1, said fins being parallelogram shaped.

7. The heat exchanger of claim 5, said fins being rhomboid shaped.

8. The heat exchanger of claim 1, said grooves being rectangular in cross section.

9. The heat exchanger of claim 1, said grooves being arcuate in cross section.

* * * * *